US012366253B2

(12) United States Patent
Sieger et al.

(10) Patent No.: US 12,366,253 B2
(45) Date of Patent: Jul. 22, 2025

(54) RADIAL FAN WITH TAPERED TONGUE GEOMETRY

(71) Applicant: ebm-papst St. Georgen GmbH & Co. KG, St. Georgen (DE)

(72) Inventors: Tobias Sieger, Geisingen (DE); Saurabh Gupta, St. Georgen (DE)

(73) Assignee: ebm-papst St. Georgen GmbH & Co. KG, St. Georgen (DE)

( * ) Notice: Subject to any disclaimer, the term of this patent is extended or adjusted under 35 U.S.C. 154(b) by 0 days.

(21) Appl. No.: 18/639,639

(22) Filed: Apr. 18, 2024

(65) Prior Publication Data

US 2024/0352944 A1 Oct. 24, 2024

(30) Foreign Application Priority Data

Apr. 21, 2023 (DE) ..... 10 2023 110 184.6

(51) Int. Cl.
*F04D 29/42* (2006.01)
*F04D 17/00* (2006.01)
*F04D 29/28* (2006.01)

(52) U.S. Cl.
CPC ..... *F04D 29/4233* (2013.01); *F04D 17/00* (2013.01); *F04D 29/281* (2013.01)

(58) Field of Classification Search
CPC .... F04D 29/4233; F04D 29/281; F04D 17/00; F04D 29/422; F04D 29/4226;
(Continued)

(56) References Cited

U.S. PATENT DOCUMENTS 7,284,952 B2 * 10/2007 Huang ..... F04D 29/667 415/206
8,083,477 B2 * 12/2011 Hwang ..... F04D 29/422 415/206

(Continued)

FOREIGN PATENT DOCUMENTS

CN 102518603 A * 6/2012
CN 104196762 A * 12/2014

(Continued)

OTHER PUBLICATIONS

Brandtner DE 43 13 617—Espacenet_English Machine Translation (Year: 1994).*

*Primary Examiner* — David E Sosnowski
*Assistant Examiner* — Wayne A Lambert
(74) *Attorney, Agent, or Firm* — Dickinson Wright PLLC

(57) ABSTRACT

Radial fan has tapered tongue geometry, impeller with impeller blades extending in radial direction about axis of rotation, and volute casing accommodating impeller rotatable about axis of rotation. Impeller blades each have a radially outward end edge, and end edges directly adjacent in circumferential direction that span an imaginary surface therebetween. Volute casing has outlet port for radially ejecting a fluid flow by impeller that is delimited in circumferential direction about axis of rotation by a tongue. At transition to a spiraled casing part of volute casing, the tongue has radially inward inner edge with two sections transitioning into one another via an extremum at a transition point. At least one section is inclined relative to axis of rotation and/or relative to radially outward end edges of impeller blades and intersects with at least one radially outward end edge and adjacent lateral surface up to its center in radial direction.

16 Claims, 2 Drawing Sheets

(58) Field of Classification Search
CPC ..... F04D 29/441; F04D 17/16; F04D 25/08; F05D 2250/52
See application file for complete search history.

(56) References Cited

U.S. PATENT DOCUMENTS

| | | | | | |
|---|---|---|---|---|---|
| 9,624,932 | B2 * | 4/2017 | Jeon | ..... | F24F 1/0022 |
| 2008/0193285 | A1 * | 8/2008 | Spaggiari | ..... | F04D 29/422 415/206 |
| 2015/0198178 | A1 * | 7/2015 | Kawasaki | ..... | F04D 29/441 415/119 |
| 2018/0209440 | A1 * | 7/2018 | Kono | ..... | F04D 29/663 |

FOREIGN PATENT DOCUMENTS

| | | | | | | |
|---|---|---|---|---|---|---|
| CN | 203978927 | U | * | 12/2014 | | |
| CN | 107676304 | A | * | 2/2018 | | |
| CN | 207080414 | U | * | 3/2018 | ..... | F04D 29/4206 |
| CN | 108869405 | A | * | 11/2018 | ..... | F04D 29/4233 |
| DE | 4313617 | C1 | * | 5/1994 | ..... | F04D 29/422 |
| DE | 10 2017 103 933 | A1 | | 8/2018 | | |
| DE | 10 2020 124 717 | A1 | | 4/2021 | | |
| DE | 10 2021 206 139 | A1 | | 12/2022 | | |
| EP | 2 146 097 | A1 | | 1/2010 | | |
| EP | 3211242 | A1 | * | 8/2017 | ..... | F04D 29/283 |
| WO | WO-2021114739 | A1 | * | 6/2021 | ..... | F04D 29/422 |

* cited by examiner

RADIAL FAN WITH TAPERED TONGUE GEOMETRY

FIELD

The invention relates to a radial fan with a tapered and preferably curved tongue geometry.

BACKGROUND

The statements in this section merely provide background information related to the present disclosure and several definitions for terms used in the present disclosure and may not constitute prior art. Conventional art discloses a variety of radial fans with a wide range of casing shapes in which the geometry of the outlet port also varies with its tongue.

In principle, radial fans comprise a spiraled volute casing having a suction or inlet port at which, for example, air or another fluid to be conveyed is axially drawn in, and a pressure or outlet port at which the fluid is radially ejected.

In this case, the pressure or outlet port, hereinafter referred to only as the outlet port, in addition to the walls delimiting the outlet port in the axial direction, has a radially outer wall and a radially inner wall, which is referred to as a tongue.

The air or fluid flow generated by an impeller arranged in the volute casing to be rotatable about an axis of rotation is typically directed radially outward in a spiraled part of the casing through an outer wall of the volute casing. Upon passage of the fluid flow to the outlet port, the fluid flow is directed radially outward of the radially outer wall of the outlet port, the outer wall of the volute casing usually transitioning into the radially outer wall of the outlet port essentially without disturbances, i.e., without generating flow obstacles or without generating disturbances in the fluid flow. The fluid flow is directed radially inward by the tongue, the fluid flow impacting on a radially inward inner edge of the tongue when flowing out of the spiraled part of the volute casing and when flowing into the outlet port. However, the impact of the flow on the inner edge results in a disturbance of the fluid flow and thus in a loss of power and undesired noise generation.

In order to avoid these disadvantages, various solutions have already been known in the prior art. For example, the transition from the inner edge to the spiraled part of the volute casing is rounded and designed to be stepless, or the inner edge is inclined throughout such that the fluid flow does not impact on a hard edge while simultaneously not impacting on the entire edge.

For example, EP 2 146 097 A1 teaches to round the inner edge of the tongue and to incline it in sections by means of an extension, such that the tongue extends into the volute casing with the extension and the flow does not suddenly impact on the inner edge across the entire length thereof.

Contrary thereto, DE 10 2021 206 139 A1 teaches to reduce the pressure at the inner edge of the tongue by means of a damper, such that the fluid flow may be directed across the inner edge with as little disturbance as possible, improving the noise characteristics, but still leading to pressure losses, i.e., efficiency losses.

SUMMARY

An objective of example embodiments of the present disclosure is to overcome the disadvantages mentioned above and to provide a radial fan with improved performance and noise characteristics. For example, another objective is to reduce noise generation and power losses caused by the fluid flow that may be generated impacting on the inner edge of the tongue when passing from the spiraled casing part of the volute casing into the outlet port.

Objectives herein are achieved by the combination of features such as a radial fan with a tapered tongue geometry, and having an impeller with a plurality of impeller blades extending in the radial direction about an axis of rotation), and a volute casing accommodating the impeller rotatable about the rotational axis. The impeller blades each have a radially outward end edge and respective two end edges directly adjacent in the circumferential direction span an imaginary lateral surface therebetween, The volute casing has an outlet port for radially ejecting a fluid flow that may be generated by the impeller and which is delimited in the circumferential direction about the axis of rotation by a tongue. The tongue has a radially inward inner edge at a transition to a spiraled casing part of the volute casing, having two sections which transition into one another via an extremum at a transition point, wherein at least one of the sections is inclined relative to the axis of rotation and/or relative to the radially outward end edges of the impeller blades and intersects with at least one of the radially outward end edges and a respective adjacent lateral surface up to its center in a projection in the radial direction.

Further features will become apparent from the description provided herein. It should be understood that the description and specific examples are intended for purposes of illustration only and are not intended to limit the scope of the present disclosure.

BRIEF DESCRIPTION OF THE DRAWINGS

Example embodiments of the present invention are presented below with reference to the figures in the drawings, in which.

Figure 1:
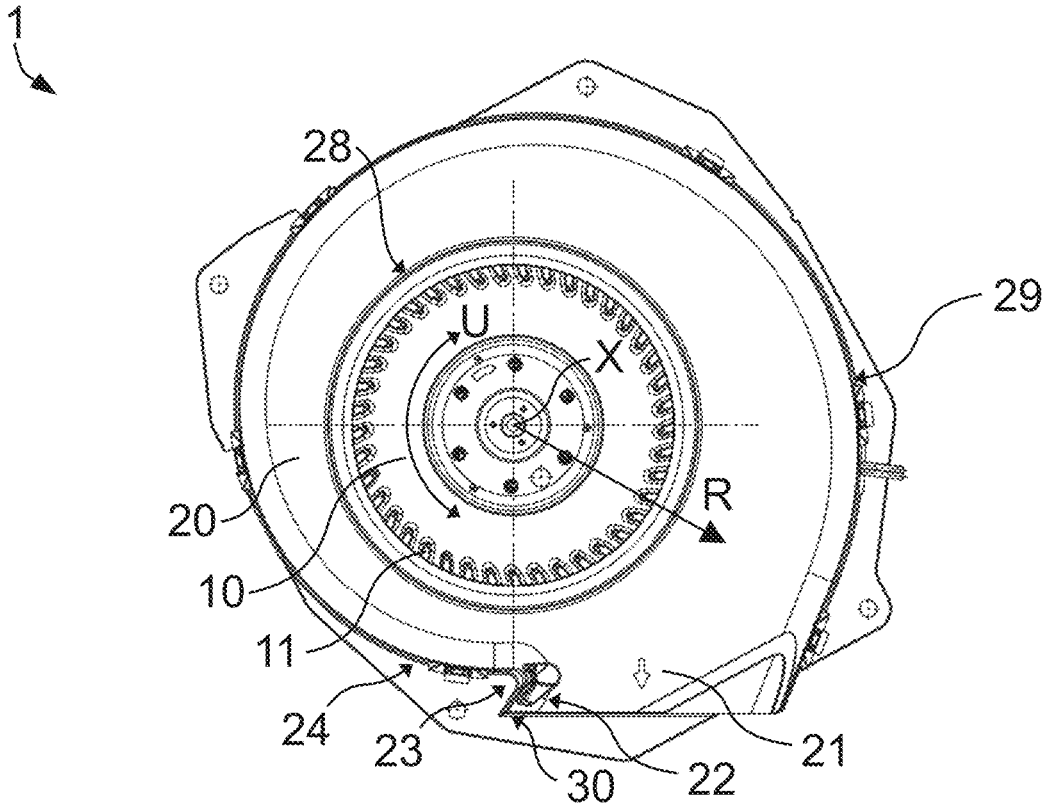
FIG. 1 shows a radial fan in an axial top view.

The drawings are provided herewith for purely illustrative purposes and are not intended to limit the scope of the present invention. The figures are schematic for illustration.

DETAILED DESCRIPTION

The following description is merely exemplary in nature and is in no way intended to limit the present disclosure or its application or uses. It should be understood that throughout the description, corresponding reference numerals indicate like or corresponding parts and features.

In accordance with example embodiments of the present invention, a radial fan with a tapered and, in particular, curved tongue geometry is provided. The radial fan has an impeller with a plurality of impeller blades extending in the radial direction about an axis of rotation, and a volute casing accommodating the impeller rotatable about the axis of rotation. The impeller blades each have a radially outer end edge, wherein respective two end edges directly adjacent in the circumferential direction each span an imaginary lateral surface therebetween. Furthermore, the impeller blades may also be curved backwards or, in particular, forwards. The volute casing has an outlet port for radially ejecting an air or, in particular, fluid flow that may be generated by the impeller and is delimited in the circumferential direction about the axis of rotation by a tongue. As already described, the outlet port may be delimited radially outward by a radially outer wall of the outlet port which transitions into a radial wall of the volute casing or a radial wall of the spiraled casing part of the volute casing. In particular, a radially inner transition of the tongue into the spiraled casing part of the volute casing is located in a region or at a point where a radial distance between the radial wall of the volute casing and the axis of rotation is minimal. At the transition to the spiraled casing part of the volute casing, the tongue has a radially inward inner edge that in turn has two sections which transition into one another via an extremum at a transition point. At least one of the sections, but preferably both sections, are inclined relative to the axis of rotation and/or the radially outward end edges of the impeller blades. In addition, it is provided for the at least one section of the inner edge or both sections each to intersect, in a projection in the radial direction, with at least one of the radially outer end edges of the impeller blades and a lateral surface adjacent thereto in the circumferential direction up to the center thereof.

Preferably, the end edges are a single, radially outer edge of an impeller blade, at which surfaces determining the pressure and suction sides of the impeller blade meet at an acute angle. Alternatively, an impeller blade may have a radially outward surface extending in the circumferential direction, for example, via which surfaces determining the pressure and suction sides of the impeller blade transition into one another. In such a variant, the entire surface extending in the circumferential direction may be understood as an end edge and is correspondingly intersected in the projection by the inner edge.

Preferably, in the projection, the inner edge always, i.e., independently of the rotational position of the impeller, intersects with at least one and, in particular, at least or exactly two of the end edges of the impeller blades as well as the lateral surface located therebetween.

Furthermore, the inner edge may have at least one uniform or varying concave and/or convex curvature, the vertex of which forms the extremum.

Inclining or tilting the inner edge, in particular in combination with a curvature of the inner edge and the intersection of the end edges and the lateral surface, significantly reduces the impact of the fluid or the air in the fluid flow on the inner edge in a particularly advantageous manner, thereby reducing the pressure losses and also the noise level resulting therefrom.

In particular, the inner edge corresponds to the boundary or boundary line between a plane or surface of the tongue extending, when viewed from the top, substantially linearly or alternatively in a curved manner and the transition to the spiraled casing part, the transition correspondingly not extending linearly, but in a curved manner.

It may further be provided for the transition point to bisect or being located in the center of the inner edge in the axial direction, i.e., along the axis of rotation, and in a central plane centrally dividing the outlet port in an axial direction and, in particular, dividing it symmetrically in a respectively designed outlet port.

Furthermore, it may be provided for the inner edge to have two outer peripheral points in the axial direction and an intermediate point located therebetween and, in particular, centrally between the peripheral points, wherein the intermediate point of the inner edge may be the transition point of the inner edge. In a first variant, the peripheral points and the intermediate point have a substantially identical distance from the axis of rotation in the radial direction, i.e., in an axial view, they are concentric about the axis of rotation on a common circle. Alternatively, it may be provided for the peripheral points to have a greater distance from the axis of rotation in the radial direction than the intermediate point, or for the intermediate point to have a smaller distance from the axis of rotation than the peripheral points.

An advantageous variant also provides for a cross-section of the outlet port passable by a flow at the inner edge to increase or flare from an outer peripheral section of the inner edge in the axial direction to a central section in the axial direction and in particular to the intermediate and/or transition point of the inner edge with the inner edge having a concave curvature, and to decrease with the inner edge having a convex curvature.

Preferably, the inner edge is determined by, in particular, three curvatures which transition into one another steplessly without any kinks. A first curvature is provided on each of the outer peripheral sections in the axial direction, each transitioning into a common and also lesser second curvature.

Preferably, the transition of the tongue to the spiraled casing part of the volute casing is also rounded and/or stepless and/or free of kinks. In particular, the radius or the curvature by which the transition between the tongue and the spiraled casing part is determined may vary across the transition in the axial direction.

According to another advantageous variant, the tongue may terminate at a radially outward outer edge which also has two sections transitioning into one another via an extremum at a transition point. At least one of the sections of the outer edge, but preferably both sections of the outer edge, is/are each inclined relative to the axis of rotation and/or radially outward end edges of the impeller blades. In a projection in the radial direction, the section(s) intersect(s) with at least one of the radially outward end edges and a respective adjacent lateral surface in the circumferential direction, in particular, by a quarter and/or up to its center.

The outer edge may also have at least one uniform or varying concave and/or convex curvature, the vertex of which forms the extremum of the outer edge.

In turn, the transition point at the outer edge may bisect the end edge in the axial direction or be located centrally therein and may, in particular, be located in a or the central plane dividing centrally the outlet port and/or the impeller blades in the axial direction and preferably dividing the same symmetrically.

The outer edge may have two outer peripheral points in the axial direction and an intermediate point located therebetween and, in particular, centrally between the peripheral points, which intermediate point may be the transition point of the end edge. According to a first variant, the peripheral points and the intermediate point have a substantially identical distance from the axis of rotation in the radial direction. According to the second variant, however, it is provided for the peripheral points to have a greater distance from the axis of rotation than the intermediate point.

As mentioned, the outer edge may have a uniform or varying concave and/or convex curvature, such that a cross-section of the outlet port passable by a flow at the outer edge increases or flares from an outer peripheral section of the outer edge in the axial direction to a central section in the axial direction or to the intermediate and/or transition point of the outer edge with a concave curvature and decreases with a convex curvature.

Preferably, the outer edge is also determined by, in particular, three curvatures which transition into one another steplessly without any kinks. A first curvature is provided on each of the outer peripheral sections in the axial direction, each transitioning into a common and also lesser second curvature.

The curvature and/or individual curvatures of the outer edge may be less than a curvature of the inner edge. In addition or alternatively, the cross-section of the outlet port passable by a flow may be smaller at the inner edge than at the outer edge.

For the curvatures on both the inner edge and the outer edge, the respective first curvatures may be concave, for example, and the respective second curvature located therebetween may be convex.

At the tongue, a plane being curved and/or stepless and in particular without any kinks may span between the inner edge and the outer edge, which plane correspondingly delimits a cross-section of the outlet port passable by a flow, the curvature of which decreases in particular uniformly from the inner edge to the outer edge.

Preferably, both the inner edge and in particular the outer edge extend steplessly and without any kinks.

The features disclosed above may be used in any combination, as far as this is technically feasible and they do not contradict one another.

FIG. 1 shows a radial fan 1 in an axial top view with the suction or inlet port 28 of the volute casing 20 and, therethrough, the impeller 10 arranged in the volute casing 20 being visible.

The impeller 10 is arranged in the volute casing 20 so as to be rotatable about the axis of rotation X, a plurality of impeller blades 11 of the impeller 10 extending radially outwards in the radial direction R, whereby an air or fluid flow may be generated when the impeller 10 is rotating.

Thus, the impeller 10 draws in air or a fluid through the inlet port 28 while rotating in the circumferential direction U about the axis of rotation X, transports it into the spiraled casing part 24 and there, as in the variant shown, clockwise about the axis of rotation X in order to eject the fluid from the volute casing 20 at the outlet port 21 opening in the radial direction R.

Radially outward, this fluid flow is directed by the casing wall 29 radially delimiting the volute casing 20 or the spiraled casing part 24, wherein the fluid flow or the fluid, upon passage from the spiraled casing part 24 into the outlet port 21, impacts radially inward on a transition 23 of the spiraled casing part 24, on the so-called tongue 22 of the outlet port 21, delimiting it radially inward.

This results in power losses and noise generation which are to be optimized, i.e., minimized.

Figure 2:
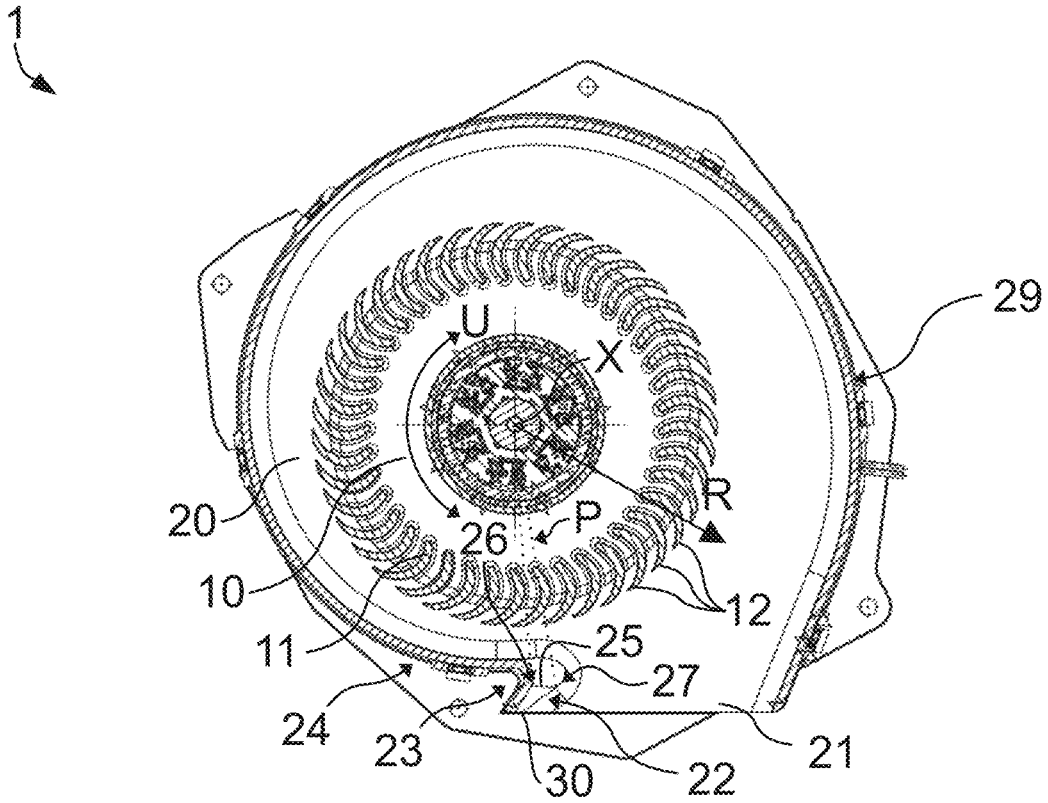
FIG. 2 shows the radial fan in a sectional view.

To reduce the losses and the noise generated, in the illustrated variant of the radial fan 1, as shown in FIG. 2 in particular, it is provided for the tongue 22 to have a radially inward inner edge 25 at the transition 23 to a spiraled casing part 24 of the volute casing 20, which is inclined relative to the axis of rotation X and relative to radially outward end edges 12 of the impeller blades 11 and intersects with at least two of the radially outward end edges 12 of the impeller blades 11 in a projection in the radial direction R.

As also shown in FIG. 2, the inner edge 25 is not arranged in the transition 23 from the tongue 22 into the spiraled casing part 24, but rather forms the boundary or boundary line between a section of the tongue 22 extending linearly in the axial view and the transition 23 characterized by radii and fillets into the spiraled casing part 24.

Figure 3:
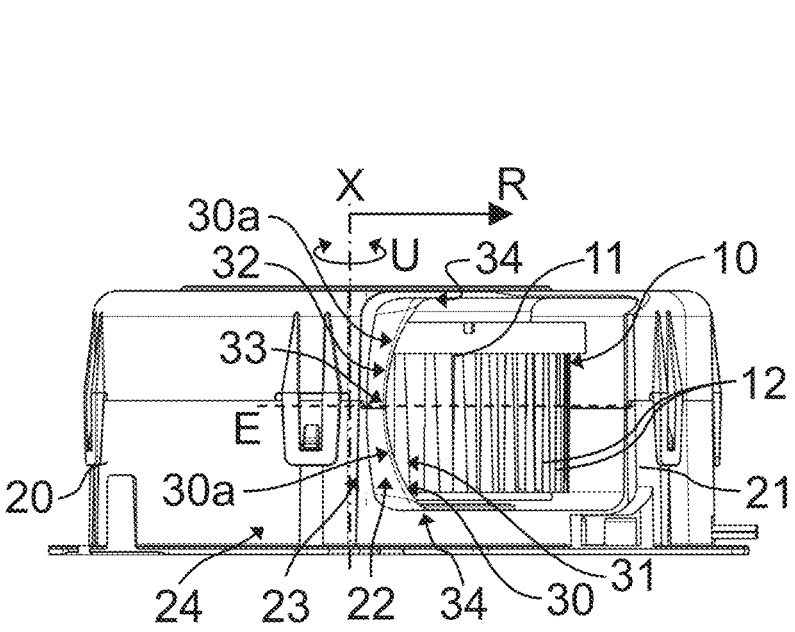
FIG. 3 shows the radial fan in a side view.

The inner edge 25 has two sections, exactly one such section being visible in the sectional view of FIG. 2, since the section is in the central plane E which centrally divides the outlet port in the axial direction, as shown in FIG. 3. The two sections extend from a respective outer peripheral point 27 located on the outside of the tongue 22 in the axial direction to a common transition point 26, at which the sections transition into one another. The two sections are inclined or tilted in opposite directions relative to one another, each intersecting with two of the radially outward end edges 12 in a projection in the radial direction. Two dotted projection lines P are indicated for illustration, a first projection line P extending from the transition point 26 and a second projection line P extending from the visible peripheral point 27 in the radial direction R to the axis of rotation X. As may be seen from the projection lines P, the sections of the inner edge 25 each and always intersect with exactly two of the end edges 12 of the impeller blades 11, independently of the rotational position of the impeller 10.

This geometric ratio already results in a particularly advantageous reduction of power loss and noise or sound level generated during operation. This advantageous behavior is additionally improved by the fact that, in a side view in the radial direction, as shown in FIG. 3, for example, the inner edge 25 or the sections of the inner edge 25 do not extend linearly, but are concavely curved, the inner edge 25 in the variant shown being determined substantially by two or three curvatures steplessly transitioning into one another without any kinks.

At the outer peripheral points 27, a first curvature is provided (e.g., as indicated at 25*a* in FIG. 4), which respectively transitions into a common second curvature having an extremum in the transition point 26 and being less curved than the first curvature.

In order not to lose the advantageous effects generated at the inner edge 25 across the tongue 22, it is provided for an outer edge 30 of the tongue 22 located outward in the radial direction R, as also visible in FIGS. 1 and 2, is designed similarly to the inner edge 25.

With reference to FIG. 3, it should be noted that the outer edge 30 of the tongue 22, at or with which the outlet port 21 terminates in the radial direction R, also has two sections 31, 32 inclined in opposite directions relative to one another and extending towards one another from a respective outer peripheral point 34 to an intermediate or transition point 33 located in the central plane E and where the sections 31, 32 transition into one another.

The outer edge 30 or the extension of the outer edge 30 is also determined by two or three curvatures, a respective first curvature (e.g., as indicated at 30*a* in FIGS. 3 and 4) at the peripheral points 34 transitioning into a common and also smaller second curvature through the transition point 33 with its extremum at the transition point 33.

However, contrary to the inner edge 25, the sections 31, 32 of the outer edge 30 are not required to intersect with respective two of the end edges 12 of the impeller blades 11 in a projection in the radial direction. Herein, for example, it is provided for the sections 31, 32 of the outer edge 30 to each and always intersect with exactly one of the end edges 12, i.e., independently of the rotational position of the impeller 10.

The plane at the tongue 22 delimiting a cross-section of the outlet port 21 passable by a flow from the inner edge 25 to the outer edge 30 is also curved and stepless and free of any kinks, and the curvatures at the inner edge 25 transition uniformly into the curvatures of the outer edge 30.

Figure 4:
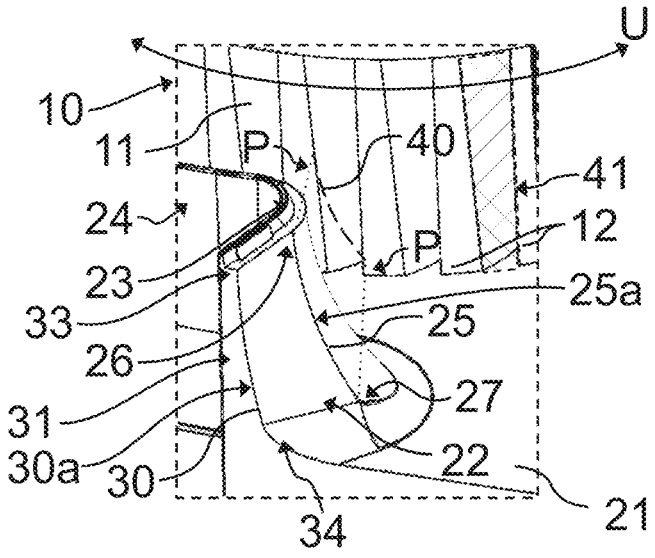
FIG. 4 is a perspective detailed view of the region of the tongue of the radial fan.

Moreover, FIG. 4 shows a perspective detailed view of the radial fan 1 according to FIGS. 1 to 3, the detailed view showing the region of the tongue 22 or of the outlet port 21 in an enlarged manner. The perspective representation particularly clearly shows the extension of the inner edge 25 that forms the boundary line between a plane spanned by the tongue 22 and the transition 23 of the tongue 22 into the spiraled casing part 24. The inner edge 25 or the tongue 22 curves concavely at the inner edge 25, such that the cross-section of the outlet port 21 passable by a flow flares from the visible peripheral point 27 to the intermediate or transition point 26.

As shown in the sectional view according to FIG. 2, the schematically indicated projection 40 of the inner edge 25 according to FIG. 4 or the section shown between the visible peripheral point 27 and the intermediate or transition point 26 of the inner edge 25 directed along the schematically indicated projection lines P in the radial direction R intersects with at least one of the radially outward end edges 12 and a respective adjacent lateral surface up to its center and, herein, specifically two directly adjacent radially outward end edges 12 and the lateral surface therebetween spanned by the two end edges 12. For further illustration, by way of example, an imaginary lateral surface 41 is indicated between two end edges 12 adjacent to the intersected end edges 12.

The practice of embodiments of the present invention is not limited to the preferred exemplary embodiments set forth above. Instead, a number of variants may be contemplated which make use of the solution shown even in case of basically different embodiments.

The invention claimed is:

1. A radial fan (1) with a tapered tongue geometry, having an impeller (10) with a plurality of impeller blades (11) extending in the radial direction (R) about an axis of rotation (X), and a volute casing (20) accommodating the impeller (10) rotatable about the rotational axis (X), wherein the impeller blades (11) each have a radially outward end edge (12) and respective two end edges (12) directly adjacent in the circumferential direction (U) span an imaginary lateral surface therebetween, wherein the volute casing (20) has an outlet port (21) for radially ejecting a fluid flow generated by the impeller (10) and which is delimited in the circumferential direction (U) about the axis of rotation (X) by a tongue (22), characterized in that the tongue (22) has a radially inward inner edge (25) at a transition (23) to a spiraled casing part (24) of the volute casing (20), having two inner edge sections which transition into one another via an extremum at a transition point (26), wherein at least one of the inner edge sections is inclined relative to the axis of rotation (X) and/or relative to the radially outward end edges (12) of the impeller blades (11) and intersects with at least one of the radially outward end edges (12) and a respective adjacent lateral surface up to its center in a projection in the radial direction (R), wherein the tongue (22) terminates at a radially outward outer edge (30) which has two outer edge sections (31, 32) transitioning into one another via an extremum at a transition point (33), and wherein at least one of the outer edge sections (31, 32) is inclined relative to the axis of rotation (X) and/or relative to the radially outward end edges (12) of the rotor blades (11).

2. The radial fan according to claim 1, wherein at least one of the inner edge sections in a projection in the radial direction (R) intersects with two of the radially outward end edges (12) and the lateral surface therebetween.

3. The radial fan according to claim 1, wherein the inner edge (25) has at least one uniform or varying concave and/or convex curvature, the vertex of which forms the extremum.

4. The radial fan according to claim 1, wherein the transition point (26) is located in a central plane (E) centrally dividing the outlet port (21) and/or the impeller blades (11) in the axial direction.

5. The radial fan according to claim 1, wherein the inner edge (25) has two outer peripheral points (27) in the axial direction and an intermediate point (26) located therebetween and corresponding to the transition point (26) of the inner edge (25), wherein the peripheral points (27) and the intermediate point (26) have a substantially identical distance from the axis of rotation (X) in the radial direction (R), or wherein the peripheral points (27) have a greater distance from the axis of rotation (X) than the intermediate point (26).

6. The radial fan according to claim 1, wherein the transition (23) of the tongue (22) to the spiraled casing part (24) of the volute casing (20) is rounded and/or stepless and/or free of kinks.

7. The radial fan according to claim 1, wherein at least one of the outer edge sections (31, 32) intersects in a projection in the radial direction (R) with at least one of the radially outer end edges (12) and a respective adjacent lateral surface.

8. The radial fan according to claim 7, wherein the outer edge (30) has at least one uniform or varying concave and/or convex curvature, the vertex of which forms the extremum.

9. The radial fan according to claim 7, wherein the transition point (33) is located in a central plane (E) centrally dividing the outlet port (21) and/or the impeller blades (11) in the axial direction.

10. The radial fan according to claim 7, wherein the outer edge (30) has two outer peripheral points (34) in the axial direction and an intermediate point (33) located therebetween and corresponding to the transition point (33) of the outer edge (30), wherein the peripheral points (34) and the intermediate point (33) have a substantially identical distance from the axis of rotation (X) in the radial direction (R), or wherein the peripheral points (34) have a greater distance from the axis of rotation (X) than the intermediate point (33).

11. The radial fan according to claim 8, wherein the curvature and/or individual curvatures of the outer edge (30) is/are less than a curvature of the inner edge (25), and/or the cross-section of the outlet port (21) passable by a flow is smaller at the inner edge (25) than at the outer edge (30).

12. The radial fan according to claim 7, wherein, at the tongue (22), a curved and/or stepless plane spans between the inner edge (25) and the outer edge (30), the curvature of which decreases from the inner edge (25) to the outer edge (30).

13. The radial fan according to claim 5, wherein the intermediate point (26) of the inner edge (25) is located centrally between the peripheral points (27) of the inner edge (25).

14. The radial fan according to claim 7, wherein the at least one of the sections (31, 32) intersects in the projection in the radial direction (R) with at least one of the radially outer end edges (12) and a respective adjacent lateral surface by a quarter and/or up to its center.

15. The radial fan according to claim 10, wherein the intermediate point (33) of the outer edge (30) is located centrally between the peripheral points (34) of the outer edge (30).

16. The radial fan according to claim 12, wherein the curvature of the plane decreases uniformly from the inner edge (25) to the outer edge (30).

* * * * *